US007168583B2

(12) United States Patent
Freeman

(10) Patent No.: US 7,168,583 B2
(45) Date of Patent: Jan. 30, 2007

(54) EXTENDABLE DRINKING UTENSIL (HEREIN REFERRED TO AS "THIS INVENTION" OR "HYPER SPACE MUG")

(76) Inventor: Thomas John Freeman, 3271 Melrose Dr., Marietta, GA (US) 30066

( * ) Notice: Subject to any disclaimer, the term of this patent is extended or adjusted under 35 U.S.C. 154(b) by 317 days.

(21) Appl. No.: 10/736,870

(22) Filed: Dec. 16, 2003

(65) Prior Publication Data

US 2004/0169039 A1 Sep. 2, 2004

(51) Int. Cl.
*B65D 6/12* (2006.01)
*B65D 81/38* (2006.01)

(52) U.S. Cl. ..... 220/8; 220/592.16; 220/4.31

(58) Field of Classification Search ..... 220/592.16, 220/4.31, 8

See application file for complete search history.

(56) References Cited

U.S. PATENT DOCUMENTS 3,285,459 A * 11/1966 Gahn ..... 220/8
4,978,021 A * 12/1990 Mini et al. ..... 220/8
6,382,449 B1 * 5/2002 Kazmierski et al. ..... 220/4.03

* cited by examiner

*Primary Examiner*—Jes F. Pascua
*Assistant Examiner*—Shawn M. Braden

(57) ABSTRACT

An insulated drinking utensil that extends to contain more liquid and enhance logo/decorative display including an outer casing, inner casing(s), a lid if desired, a handle if desired, and sealing gasket if desired. The extendable drinking container transforms from a normal drinking utensil into a larger drinking utensil capable of holding more and displaying more. This container allows individuals the convenience of turning their everyday mug into a larger container or pitcher. This container allows individuals to show off their favorite team in a new and revolutionary way. This container allows retailers to offer something completely unique to their customers while also conserving precious shelf space normally used for containers with similar storage capacity. This container also allows the end user the luxury of storing a container with a large holding capacity into a small storage area.

1 Claim, 6 Drawing Sheets

EXTENDABLE DRINKING UTENSIL (HEREIN REFERRED TO AS "THIS INVENTION" OR "HYPER SPACE MUG")

CROSS REFERENCE TO RELATED APPLICATIONS

Not Applicable

STATEMENT REGARDING FEDERALLY FUNDED SPONSORED RESEARCH OR DEVELOPMENT

Not Applicable

BACKGROUND OF THE INVENTION

This invention relates to an improved drinking utensil wherein the user is able to regulate the amount of liquid contained within the drinking utensil by extending a portion of the drinking utensil. This invention is a product designed to enhance the experience of drinking from a container. This invention allows the user to regulate the amount of consumable formulations within a container beyond that of normal proportions. This invention has the potential to act as a thermo drinking utensil with dual wall design when not extended and extend for the purpose of holding more liquid when desired. This invention allows for logo and art decoration which other drinking utensils can not accomplish.

Presently, there are many different drinking utensils commonly used to contain liquid for the purpose of consuming a variety of consumable formulations. In recent times supersizing has become quite popular. Everywhere the ordinary individual eats, drinks, or shops, he/she is given the option of consuming the largest portion available. Yet, if the consumer buys a 64 ounce drinking utensil at a convenience store, department store, amusement park, stadium, or any other outlet, he/she has been stuck with only that size of container which may only be used for the type of consumable that particular container holds. This invention allows the person who prefers one particular drinking utensil the choice to use that drinking utensil for their morning coffee, their afternoon beverage, their tailgating beverage, their families picnicking beverage or whatever they desire to use it for. This invention also allows the consumer and the retailer to conserve shelf space because although this invention may hold a certain amount of a formulation extended it is able to take up less space when not extended. Currently, there are drinking utensils being manufactured which allow for the extension of liquid capacity. Prior art discloses extendable drinking utensils which act like an accordion in order to produce the function of extending or expanding liquid or formulation capacity. These methods of assistance in extending or expanding liquid or formulation capacity are satisfactory in their function However, these extendable drinking utensils do not allow for the proper housing of hot and cold beverages and are not conducive to logo and art decoration. This invention accomplishes the desired effect of extending liquid or formulation capacity while also allowing for the proper housing of hot and cold liquids and the enhancement of logo and art decoration.

BRIEF SUMMARY OF INVENTION

This invention is directed to an improved thermo drinking utensil which may be extended for the purpose of containing a greater amount of a liquid or formulation. It is an object of this invention to effectively keep hot or cold liquids or formulations hotter or colder than a single wall unit when not extended. It is an object of this invention to extend in order to contain a greater amount of liquid or formulation when extended. It is an object of this invention to be able to pour a liquid or formulation into another container and then un-extend and regain it's thermo properties. It is an object of this invention to allow retailers and consumers the convenience of storing an item which takes up far less space than it's actual liquid or formulation capacity would normally allow for. It is the object of this invention to allow advertisers, premium incentive clients and licensors/licensees, the opportunity to display brand awareness (logo design, artwork) in a new and revolutionary way that has never been available. It is an object of this invention to allow the user to use their drinking utensil as a mug, cup, glass, drinking container, pitcher (or whatever verbage or term may be associated with the aforementioned drinking utensils).

This invention comprises an outer part or parts which work in conjunction with an inner part or parts in order to achieve the functions of; containing a liquid or formulation, extending the capacity of said liquid or formulation, buffering the temperature of said liquid or formulation, and allowing for the empowerment of logo and art decoration. This invention can be designed in several ways. The drawings depict a drinking mug or utensil with an inner attachment which unscrews or unlocks and moves upward to achieve extension and added logo and art decoration features. However, it is also the intention of this invention to be able to unscrew or unlock from the bottom of the drinking utensil in order to accomplish the same purposes. The objects remain the same. It is the intention and object of this invention to be able to provide the end user with a drinking utensil which they may use everyday. The user may use this invention as a thermo insulated mug, they may use it as a pitcher, they may use it as their favorite coffee mug, they may take it tailgating with them, they may purchase it at outdoor events for the purpose of buying drinks for themselves or the whole family. The retailer may wish to sell a great drinking utensil which they can store and display more economically. No matter which way extension is accomplished there has never been a product like the Hyper space Mug.

DETAILED DESCRIPTION OF THE INVENTION

Figure 1:
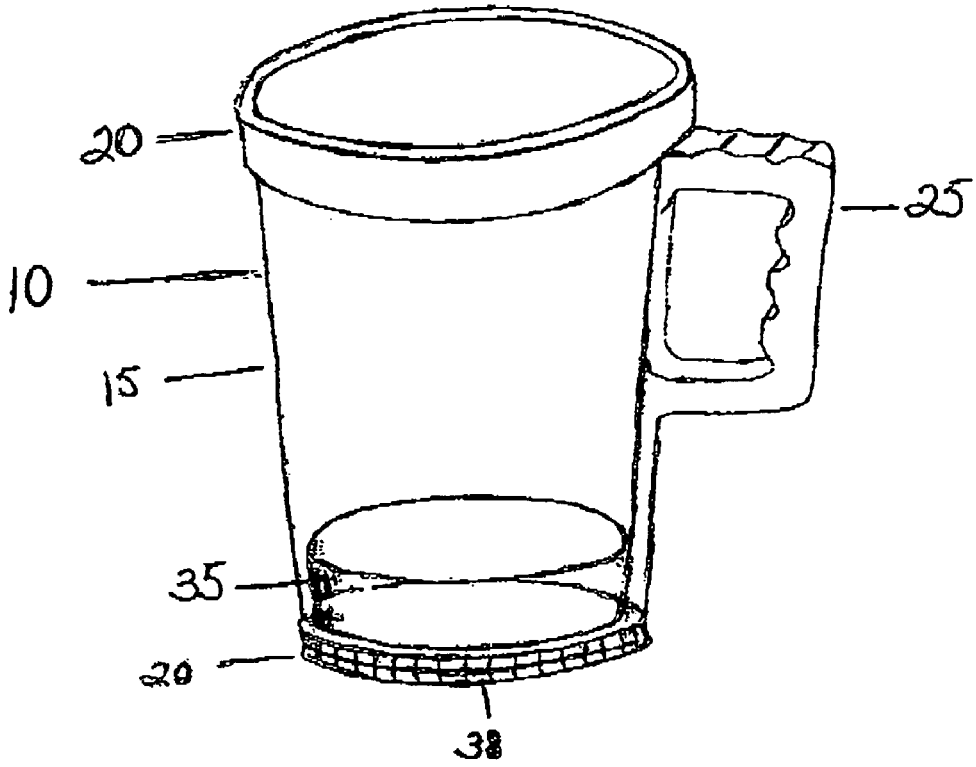
FIG. 1 is a front side view of this invention when not extended and not covered with a lid.
Figure 5:
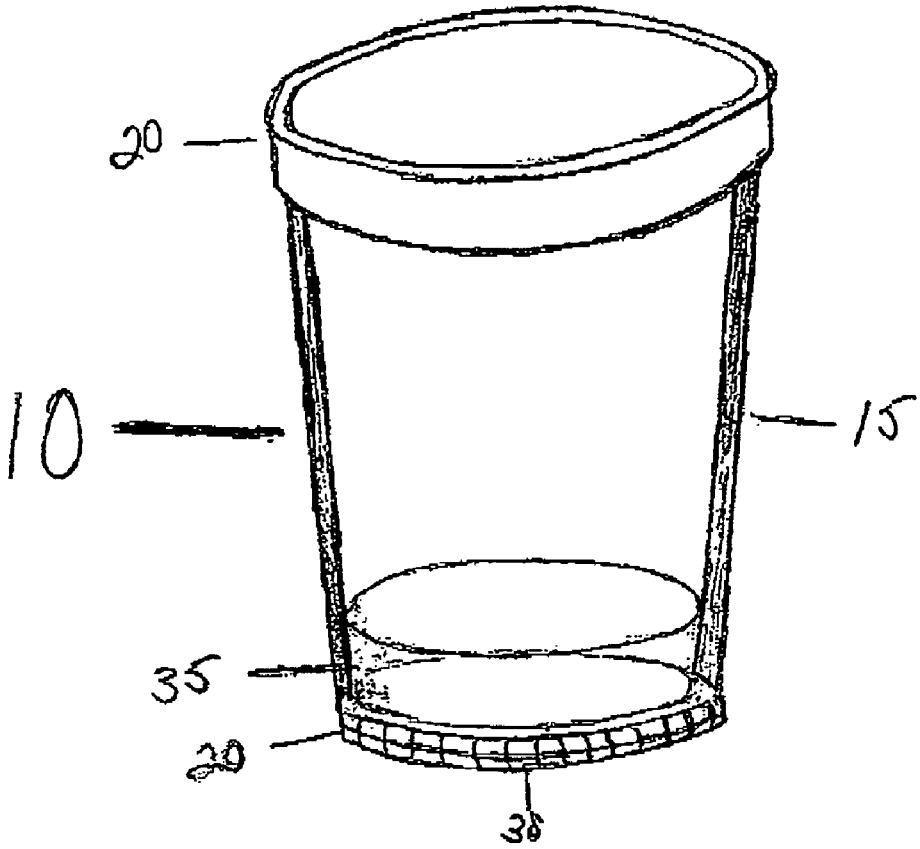
FIG. 5 is a front side view of this invention without a handle.

Broadly, this present invention comprises a drinking utensil containing an outer casing and an inner casing which work in a conjunctive manner to accomplish the functions of extension and temperature buffering. The drinking utensil itself may be of any shape, form, or size associated with drinking utensils (ex. FIG. 1 shows the extendable drinking utensil in the form of a mug while FIG. 5 shows the extendable drinking utensil as a tumbler). The distinguishing characteristic between this invention and all of those which came before it is that the supplier or the user may extend this drinking utensil to accomplish his/her desires.

FIG. 1 illustrates the extendable drinking utensil 10 in a form when it is not extended. The outer casing 15 of the drinking utensil may be constructed of a wide variety of materials. The outer casing 15 may be constructed of plastic or the like, glass or the like, metal or the like or anything that is able to be made firm enough to hold liquid and/or be fitted with grooves and/or screw on and/or screw off receptors. The inner casing 20 is attached to the outer casing and may be constructed of a variety of materials. The inner casing 20 may be constructed of plastic or the like, glass or the like, metal or the like, or any material that is able to be made firm enough to hold liquid and or be fitted with grooves and/or screw on and/or screw off receptors. The inner casing 20 may attach or be inserted into the outer casing in several different ways. FIG. 1 shows the inner casing 20 attaching to the top of the outer casing 15. FIG. 1 also shows the inner casing 37 attaching to the bottom of the outer casing 15 and equipped with grooves 38 to assist the user in achieving extension. The inner casing 37 is the same as the inner casing 20, different reference numbers are used here to illustrate the fact that the inner casing may be primarily attached to the top of the outer casing 15 or primarily attached to the bottom of the outer casing 15 (ex. this invention may be extended upwards or downwards depending on the desire of the manufacturer.) In the event that extension is accomplished by moving the inner casing 20 in an upward manner, an insulated bottom 35 may be used. The insulated bottom 35 may be constructed of the aforementioned variety of materials relative to the outer casing 15 and the inner casing 20. FIG. 1 shows the extendable drinking utensil 10 in it's drinking mug form utilizing a molded on handle 25. The handle 25 may be constructed of the same variety of materials relative to the outer casing 15 and the inner casing 20.

Figure 2:
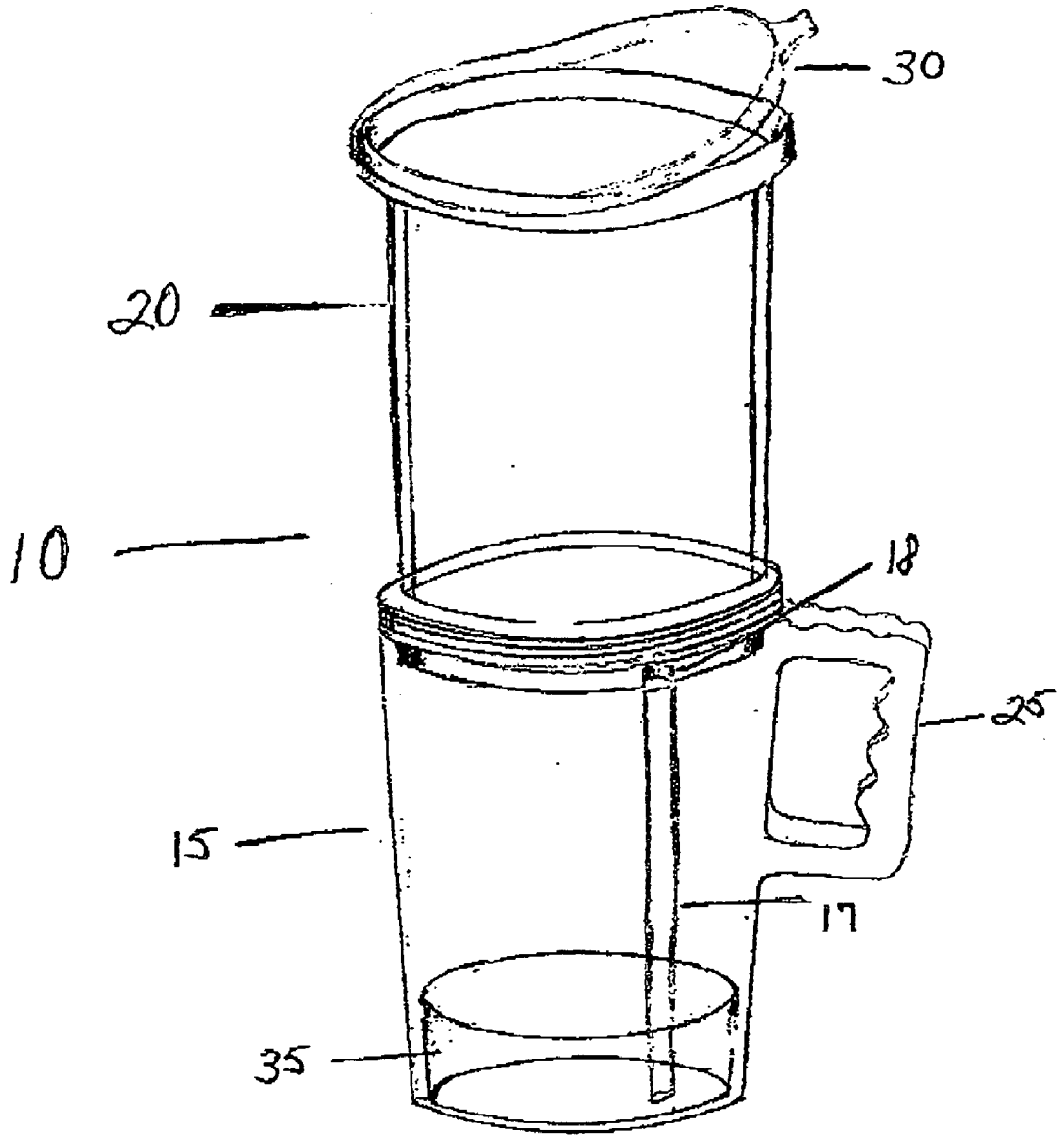
FIG. 2 is a front side view of this invention when extended and covered with a lid.

FIG. 2 illustrates the extendable drinking utensil 10 when extended and covered with a lid 30. The lid 30 may be constructed of a wide variety of materials. The lid 30 may be constructed of plastic or the like, glass or the like, metal or the like, or any material which is able to be made firm enough to hold liquid and or be fitted with grooves, fixtures, and or screw on and/or screw off receptors. The lid 30 serves the function of covering and sealing the top of this invention. The lid 30 also serves the function of acting as a direct liquid or formulation dispenser. The lid 30 may be designed to control liquid flow. The lid 30 may have a fixture which accepts a straw or other device used to consume liquid. FIG. 2 clearly illustrates the function of the inner casing 20 working in conjunction with the outer casing 15 in order to achieve extension. Extension may be accomplished in many different ways. It is not the intent of the inventor to ascribe to a particular design which accomplishes extension. It is the function of extension of this invention which is desired to be primarily addressed. For the purpose of giving an example of how extension may be achieved one might use a groove 17 which is part of the outer casing 15. The groove 17 of the outer casing 15 works in conjunction with a slot 18 which is part of the inner casing 20 enabling the inner casing to slide up or down the outer casing and lock or screw into position. This invention may be made with several chambers or levels of slots 18 or grooves 17. Once again, it is not the intention or directive of this inventor to discuss or point out the many different ways this invention may accomplish extension. It is the intention of this inventor to illustrate one scenario among many which assists in accomplishing the function or utility of this invention.

Figure 3:
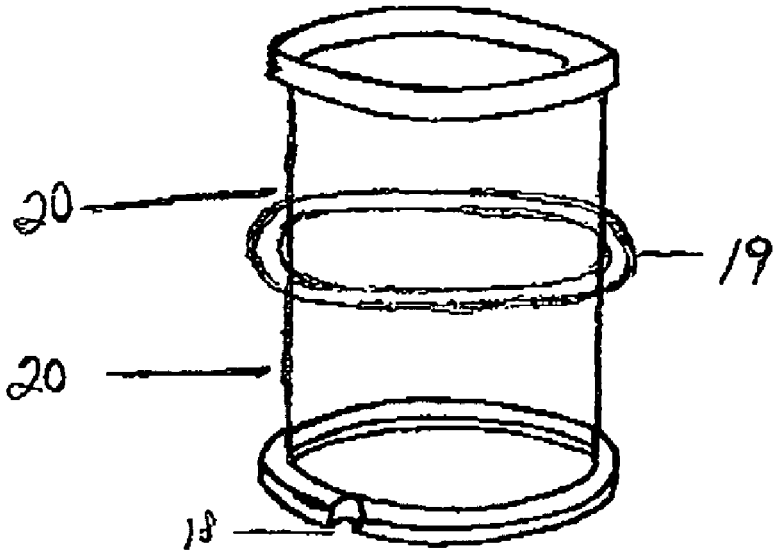
FIG. 3 is a front side view of an inner casing of this invention.

FIG. 3 shows the inner casing 20 of this invention. The inner casing 20 having at least one opened end is inserted into the outer casing 15 FIG. 1, FIG. 2, FIG. 4, FIG. 5, & FIG. 6 and works in conjunction with the outer casing in order to achieve the desired effect of extension. The inner casing 20 also serves as a temperature controlling buffer when placed completely inside the outer casing 15 FIG. 1, FIG. 2, FIG. 4, FIG. 5, & FIG. 6 giving this invention a dual wall design when not extended. FIG. 3 further shows the inner casing 20 fitted with a liquid stabilizer 19. The liquid stablizer 19 may be constructed of a wide variety of materials. The liquid stabilizer may be constructed of one or more of all aforementioned materials within the embodiment of this utility patent application. The liquid stabilizer 19 serves the function of assisting in the sealing or holding in contents which may be placed within this invention. The liquid stabilizer 19 is a type of sealing gasket This invention may come equipped with one liquid stabilizer 19 or more than on liquid stabilizer. This invention may also be made without the use or assistance of any liquid stabilizer 19.

Figure 4:
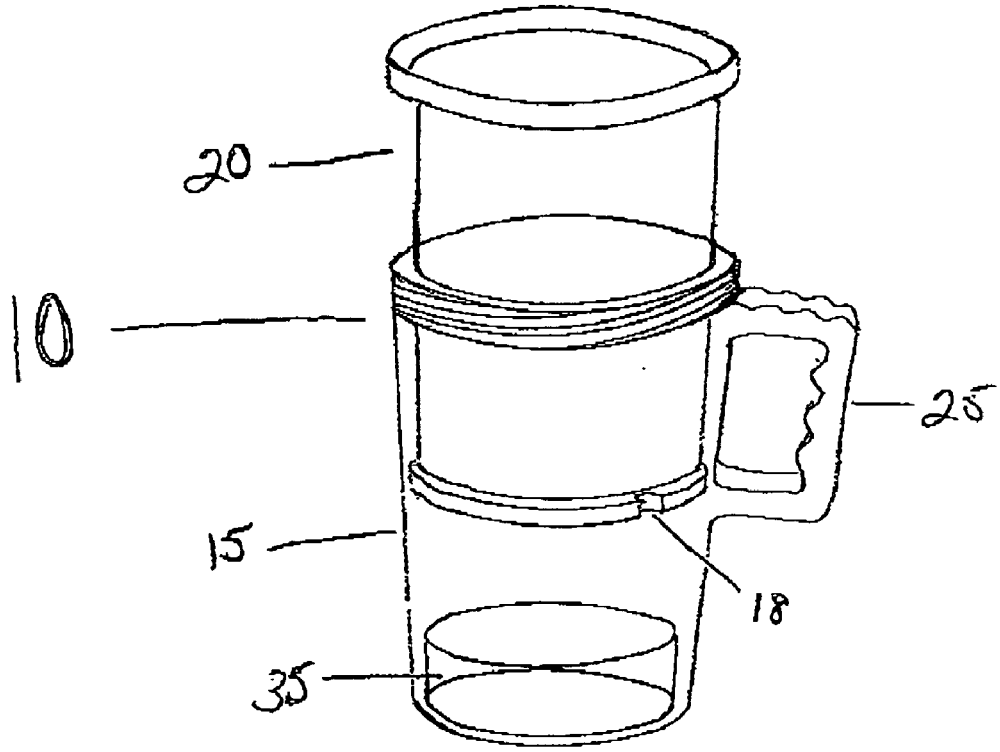
FIG. 4 is a front side view of this invention when partially extended and not covered with a lid.

FIG. 4 shows the drinking utensil 10 when partially extended. It may be a desire of a particular manufacturer or user to be able to have one or more settings or stop points on the way to full extension of this invention. It is also the desire of this invention to include partial extending settings when deemed desirable.

FIG. 5 illustrates the extendable drinking utensil 10 when not extended and without a handle 25 FIG. 1, FIG. 2, FIG. 4, & FIG. 6. In recent years there has been an emergence in popularity of dual wall designed drinking utensils. This particular design is very popular in coffee shops and other outlets. It is the intention of this invention to offer the extension option with or without a handle.

Figure 6:
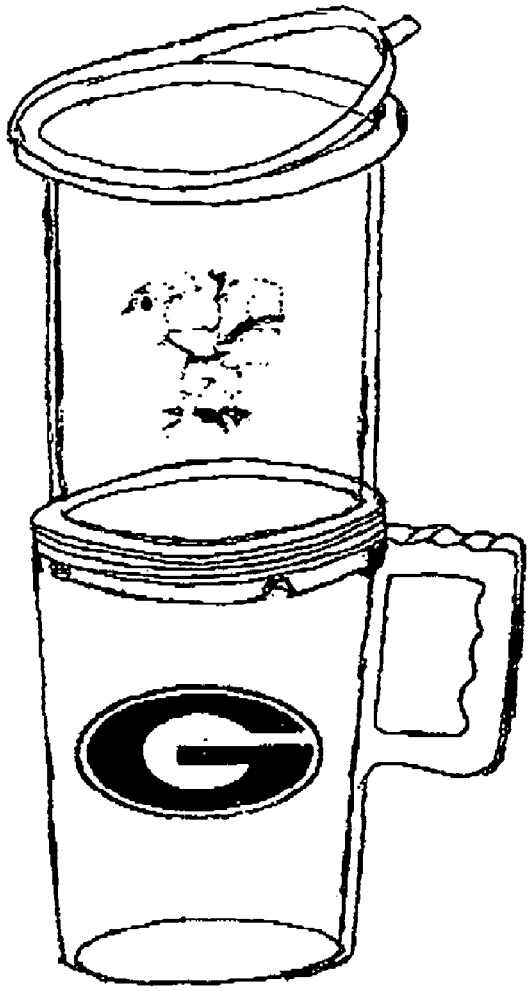
FIG. 6 is a front side view of this invention when extended and decorated with a logo.

FIG. 6 illustrates the extendable drinking utensil 10 decorated with art and logo display. The outer casing 15 is decorated with an official school logo. The inner casing 20 is decorated with artwork depicting a mascot of said school. The notion of being able to decorate an extendable drinking utensil has never been utilized before. This invention allows for decoration on the inner casing 20 and/or the outer casing 15 as well as the lid 30 when desired.

Although one embodiment has been illustrated in the accompanying drawings described in the foregoing detailed description, it will be understood that this invention is not limited to the particular embodiment discussed but is capable of numerous rearrangements, modifications, and substitutions without departing from the scope of this invention. For example, the inner casing may be made to primarily attach from the bottom of the drinking utensil and opened by releasing in a downward motion. Also instead of a dual wall design several or many walls may be used.

What is claimed is:

1. A drinking utensil with two size adjustable liquid comprising:

an outer casing with a closed round insulated bottom, said bottom includes grooves for improved grip, said outer casing being cylindrical in shape, with an annular open top, and including at least one vertical groove along an inside surface of said outer casing, an inner casing, having a generally straight sidewall, being cylindrical in shape with an open top and an open bottom with a slot adjacent the open bottom, said slot receiving said at least one vertical groove enabling the inner casing to vertically slide up and attach into an extended position and also slide down and attach within the outer casing into a collapsed position, and screw receptors located at the top and bottom of said outer casing with a corresponding component located at the bottom of said inner casing, creating a fluid tight seal between the inner and outer casing when said inner casing is in its extended position, said inner casing also includes a lid, said bottom of said outside casing being thicker than any other wall of the drinking utensil.

* * * * *